US011534364B2

(12) United States Patent
Poole

(10) Patent No.: US 11,534,364 B2
(45) Date of Patent: Dec. 27, 2022

(54) VAGINAL PROBE FOR STIMULATION AND RESPONSE RECORDING

(71) Applicant: Wayne Gerard Poole, Alexandria, VA (US)

(72) Inventor: Wayne Gerard Poole, Alexandria, VA (US)

(73) Assignee: Wayne Gerard Poole, Alexandria, VA (US)

( * ) Notice: Subject to any disclaimer, the term of this patent is extended or adjusted under 35 U.S.C. 154(b) by 326 days.

(21) Appl. No.: 16/873,677

(22) Filed: Jun. 1, 2020

(65) Prior Publication Data

US 2021/0369554 A1 Dec. 2, 2021

(51) Int. Cl.
*A61H 19/00* (2006.01)

(52) U.S. Cl.
CPC ..... *A61H 19/40* (2013.01); *A61H 19/34* (2013.01); *A61H 2201/0165* (2013.01); *A61H 2201/0188* (2013.01); *A61H 2201/5005* (2013.01); *A61H 2201/5043* (2013.01); *A61H 2201/5058* (2013.01); *A61H 2201/5097* (2013.01); *A61H 2205/087* (2013.01); *A61H 2230/06* (2013.01); *A61H 2230/30* (2013.01); *A61H 2230/50* (2013.01); *A61H 2230/60* (2013.01)

(58) Field of Classification Search
CPC ..... A61H 19/34; A61H 19/40
See application file for complete search history.

(56) References Cited

U.S. PATENT DOCUMENTS

| | | | | |
|---|---|---|---|---|
| 6,741,895 | B1 * | 5/2004 | Gafni | A61B 5/4337 600/38 |
| 8,679,014 | B2 * | 3/2014 | Bennett | A61N 5/0603 600/301 |
| 9,993,688 | B2 * | 6/2018 | Siegel | A63B 23/20 |
| 10,940,077 | B2 * | 3/2021 | Driscoll | A61H 23/02 |

* cited by examiner

*Primary Examiner* — John P Lacyk

(57) ABSTRACT

A vaginal probe with sensing and data transmitting capabilities is shown and described. The probe includes physiological sensors and an optical display including light emitting diodes on a circumferential surface. Data storage and transmission capability is contained in a docking station associated with the probe. Data can be transmitted to a remote location for analysis and/or display.

13 Claims, 2 Drawing Sheets

VAGINAL PROBE FOR STIMULATION AND RESPONSE RECORDING

FIELD OF THE INVENTION

The present invention relates to a probe to be inserted into the vagina, for sexually stimulation and for recording physiological responses to stimulation.

BACKGROUND OF THE INVENTION

There is great variation in sexual response to stimulation of the vagina and clitoris. Many physiological parameters of sexual responses can be monitored. However, the present inventor is unaware of a single instrument capable of sensing and recording data pertaining to physiological response.

SUMMARY OF THE INVENTION

The present invention provides a vaginal probe having stimulatory characteristics and also data capture and transmission characteristics. The probe may comprise a generally cylindrical probe member including a blunt penetrating end. The other end includes data and power transmission terminals. The probe is received in an associated docking station. The docking station includes a transceiver for transmitting captured physiological data to a remote station for analysis and/or display. The probe has a local display comprising for example a plurality of light emitting diodes.

The present invention provides improved elements and arrangements thereof by apparatus for the purposes described which is inexpensive, dependable, and fully effective in accomplishing its intended purposes.

These and other objects of the present invention will become readily apparent upon further review of the following specification and drawings.

BRIEF DESCRIPTION OF THE DRAWINGS

Various objects, features, and attendant advantages of the present invention will become more fully appreciated as the same becomes better understood when considered in conjunction with the accompanying drawings, in which like reference characters designate the same or similar parts throughout the several views, and wherein.

DETAILED DESCRIPTION

Figure 1:
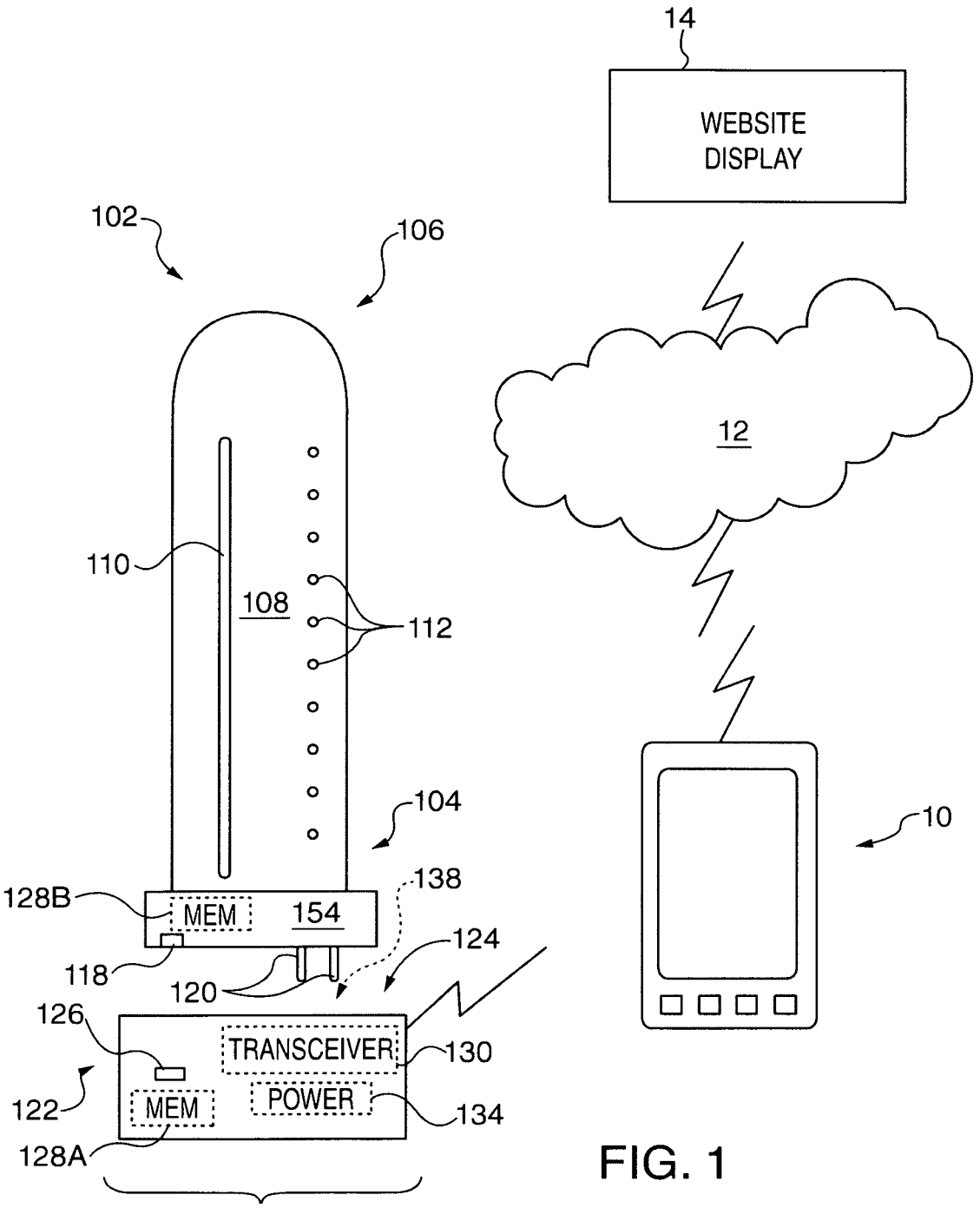
FIG. 1 is a diagrammatic environmental view of a vaginal probe according to aspects of the invention.
Figure 2:
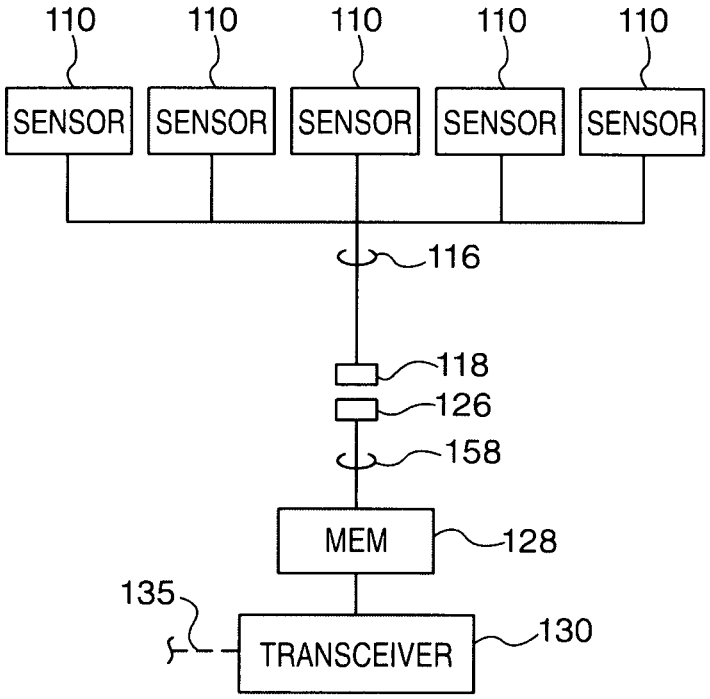
FIG. 2 is a schematic view of data handling components of the vaginal probe of FIG. 1.
Figure 3:
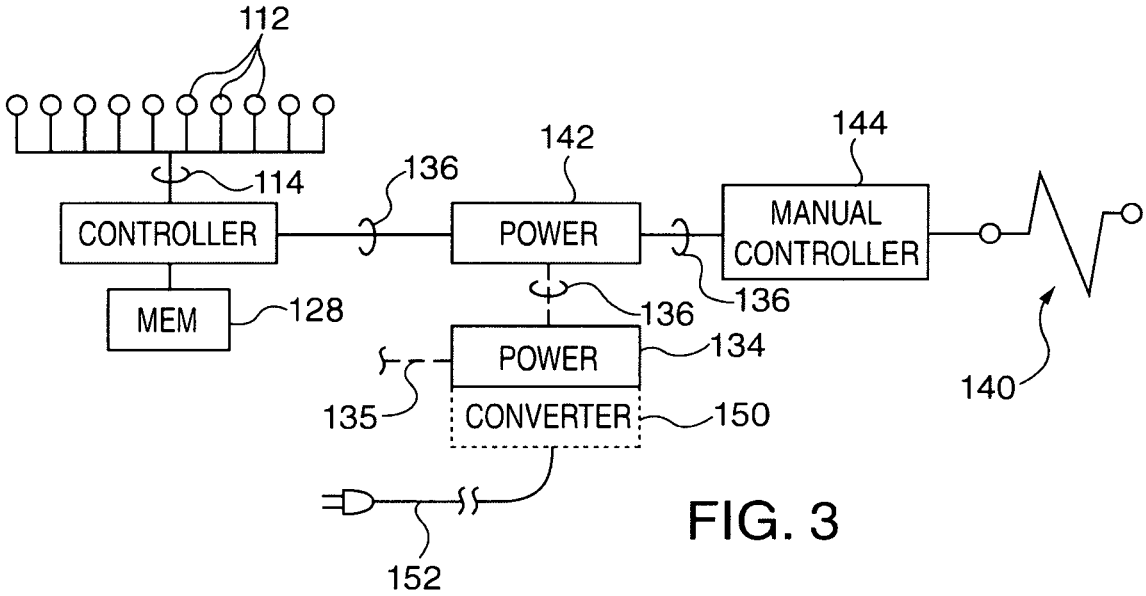
FIG. 3 is a schematic view of powered components of the vaginal probe of FIG. 1.

Referring first to FIGS. 1-3, according to at least one aspect of the invention, there is shown a vaginal probe 100 to be inserted into the vagina (not shown) for sexual stimulation and physiological response recording. Vaginal probe 100 may comprise an elongated probe 102 having a proximal end 104, a distal end 106, and a circumferential surface 108 between proximal end 104 and distal end 106. Elongated probe 102 may comprise at least one sensor 110, at least one visual display element 112, a power circuit 114 (FIG. 3) configured to conduct operating electrical power to visual display element 112 and a first data transmitting circuit 116 (FIG. 2). Distal end 106 may be blunt. Proximal end 104 may include at least one first data terminal 118 in communication with data transmitting circuit 116 and may be configured to enable data to be transmitted from sensor 110, and a power terminal 120 (internal data circuitry is not shown).

Vaginal probe 100 may include a docking station 122 comprising a receiving surface 124 interfittingly compatible with proximal end 104 of elongated probe 102, at least one second data terminal 126 enabling passage of data from first data terminal 118 of elongated probe 102, a data storage element 128, a transceiver 130, a second data transmitting circuit 132 connecting second data terminal 126, data storage element 128, transceiver 130, and an electrical power source 134. Vaginal probe 100 may further include a power circuit 135 configured to conduct operating power from electrical power source 134 to transceiver 130. Power circuit 134 may comprise power terminals 138 matingly compatible with power terminals 118 of elongated probe 102.

Optionally, visual display elements 112 may be located on docking station 122, either instead of on circumferential surface 108 or in addition thereto.

Unless otherwise indicated, the terms "first", "second", etc., are used herein merely as labels, and are not intended to impose ordinal, positional, or hierarchical requirements on the items to which these terms refer. Moreover, reference to, e.g., a "second" item does not either require or preclude the existence of, e.g., a "first" or lower-numbered item, and/or, e.g., a "third" or higher-numbered item.

Ends 104 and 106 will be understood to be semantic conveniences in identifying location of various components of elongated probe 102, and are not to be interpreted as signifying or being limited to a discrete surface of elongated probe 102.

Data and power circuits are shown schematically and described functionally. Therefore, data and power circuits will be understood to include the number of conductors, terminals, and other components necessary for an operative system even if such components are not explicitly shown or described. First data transmitting circuit 116 is extended by a corresponding second data transmitting circuit 158 (FIG. 2).

Data and power terminals 118 and 120 and receiving surface 124 will be understood to cooperate with one another for frictional fit (terminals) and to cooperate with configuration of end 104 of elongated probe 102 (receiving surface 124). These characteristics are conventional with electrical and electronic connections and docking stations of electrical appliances, and need no further explanation herein.

Operating power may be DC or AC. Where operating power is DC, power source 134 may comprise a battery (including either single or plural battery cells). Where operating power is AC, power source 134 will be supplemented by an AC-to-DC converter 150 (FIG. 3) connected for example to a plug and cord assembly 152. Plug and cord assembly 152 may be compatible with conventional household electrical outlets (not shown).

Although elongated probe 102 is shown having an enlarged head 154 at proximal end 104, enlarged head 154 may be absent, with its components contained within elongated probe 102.

Visual display element 112 may comprise for example a light emitting diode. As shown in FIGS. 1 and 3, visual display element 112 may comprise a plurality of light emitting diodes. As seen in FIG. 3, visual display element 12 may be on an exterior of elongated probe 102.

Vaginal probe 100 may further comprise a vibrator (represented as solenoid 140 in FIG. 3) in elongated probe 102 and a battery 142 in elongated probe 102. The vibrator may be used to enhance sexual stimulation, and may be conventional.

Power circuit 136 of elongated probe 102 includes a manual controller 144 controlling the vibrator. Power circuit 136 connects the vibrator, battery 142, and manual controller 144. In an alternative embodiment, manual controller 144 may comprise an on-off switch. In another alternative embodiment, manual controller 144 may comprise a multispeed switch such as a slide switch 156 (FIG. 4).

Sensor 110 may be configured to sense magnitude of at least one parameter of physiological response of the user of vaginal probe 100, wherein the at least one parameter includes presence of fluid discharge, pressure due to contraction of pelvic muscles, body temperature, heart rate, and blood pressure. As seen in FIG. 2, sensor 110 may comprise separate sensors 110, each configured to sense one of the monitored parameters. Sensors 110 may be of any known type. For example, fluid discharge may be sensed by capacitance. Pressure may be sensed by a deformable bladder exerting variable pressure on an associated variable resistance or variable current switch.

Elongated probe 102 may include a clitoral stimulator 146 on the circumferential surface. Clitoral stimulator 146 may be conventional. Optionally, one or more sensors 110 may be located on clitoral stimulator 146.

Figure 4:
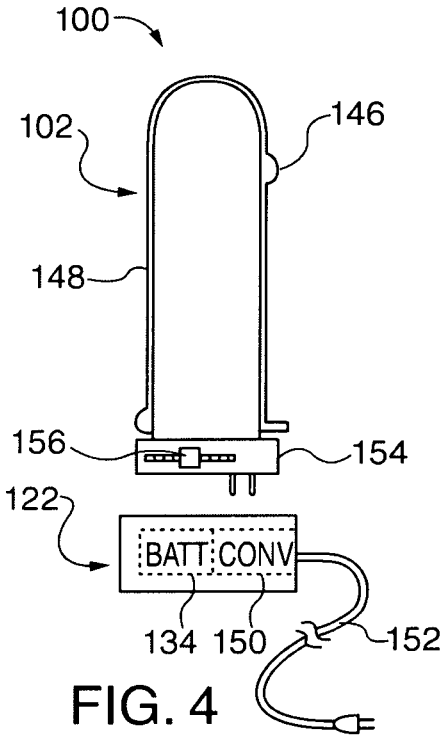
FIG. 4 is a side view showing an alternative embodiment of the vaginal probe of FIG. 1.

Referring to FIG. 4, vaginal probe 100 may further comprise a porous, discardable sleeve 148 configured to contain and cover the circumferential surface and the distal end of the elongated probe. Sleeve 148 may contain all or part of one sensor 110 for sensing any of the sensed parameters including e.g. fluids discharged as a consequence of sexual stimulation. Sensor 110 may be a capacitive sensor, for example.

Referring specifically to FIG. 1, vaginal probe 100 may be utilized in the following way. During use, physiological data may be stored in a memory 128B in elongated probe 102. Stored data may be used to illuminate visual display element 112 immediately, and may be transferred to memory 128A when elongated probe 102 is coupled to docking station 122. Transferred data may be transmitted by transceiver 130 to a communications device such as a cellular telephone 10, then through a communications channel such as the internet 12 to remote facilities for storage and display. For example, data could be displayed on a website display 14. Data transmission may utilize communications protocols such as Wi-Fi and Bluetooth, for example.

While the present invention has been described in connection with what is considered the most practical and preferred embodiment, it is to be understood that the present invention is not to be limited to the disclosed arrangements, but is intended to cover various arrangements which are included within the spirit and scope of the broadest possible interpretation of the appended claims so as to encompass all modifications and equivalent arrangements which are possible.

It should be understood that the various examples of the apparatus(es) disclosed herein may include any of the components, features, and functionalities of any of the other examples of the apparatus(es) disclosed herein in any feasible combination, and all of such possibilities are intended to be within the spirit and scope of the present disclosure. Many modifications of examples set forth herein will come to mind to one skilled in the art to which the present disclosure pertains having the benefit of the teachings presented in the foregoing descriptions and the associated drawings.

Therefore, it is to be understood that the present disclosure is not to be limited to the specific examples presented and that modifications and other examples are intended to be included within the scope of the appended claims. Moreover, although the foregoing description and the associated drawings describe examples of the present disclosure in the context of certain illustrative combinations of elements and/or functions, it should be appreciated that different combinations of elements and/or functions may be provided by alternative implementations without departing from the scope of the appended claims.

I claim:

1. A vaginal and clitoral probe to be inserted into the vagina for sexual stimulation and physiological response recording, the vaginal probe comprising:

an elongated probe having a proximal end, a distal end, and a circumferential surface between the proximal end and the distal end, the elongated probe comprising at least one sensor, a power circuit configured to conduct operating electrical power to the at least one visual display element, and a first data transmitting circuit, wherein the distal end is blunt and the proximal end includes at least one first data terminal in communication with the data transmitting circuit and configured to enable data to be transmitted from the sensor, and a power terminal;

a docking station comprising a receiving surface interfittingly compatible with the proximal end of the elongated probe, at least one second data terminal enabling passage of data from the at least one first data terminal of the elongated probe, a data storage element, a transceiver, a second data transmitting circuit connecting the at least one second data terminal, the data storage element, and the transceiver, an electrical power source;

at least one visual display element on at least one of the elongated probe and the docking station; and a power circuit configured to conduct operating power from the electrical power source to the transceiver, the power circuit comprising a second power terminal matingly compatible with the power terminal of the elongated probe.

2. The vaginal and clitoral probe of claim 1, further comprising a vibrator in the elongated probe and a battery in the elongated probe, wherein the power circuit of the elongated probe includes a manual controller controlling the vibrator, and the power circuit connects the vibrator, the battery, and the manual controller.

3. The vaginal and clitoral probe of claim 2, wherein the manual controller comprises an on-off switch.

4. The vaginal and clitoral probe of claim 2, wherein the manual controller comprises a multispeed switch.

5. The vaginal and clitoral probe of claim 1, wherein the sensor is configured to sense magnitude of at least one parameter of physiological response of the user of the vaginal probe, wherein the at least one parameter includes presence of fluid discharge, pressure due to contraction of pelvic muscles, body temperature, heart rate, and blood pressure.

6. The vaginal and clitoral probe of claim 1, wherein the elongated probe includes a clitoral stimulator on the circumferential surface.

7. The vaginal and clitoral probe of claim 6, further comprising at least one sensor is on the clitoral stimulator.

8. The vaginal and clitoral probe of claim 1, wherein the at least one visual display element comprises a light emitting diode.

9. The vaginal and clitoral probe of claim 1, wherein the at least one visual display element comprises a plurality of light emitting diodes.

10. The vaginal and clitoral probe of claim 1, wherein the at least one visual display element is on an exterior of the elongated probe.

11. The vaginal and clitoral probe of claim 1, further comprising a porous, discardable sleeve configured to contain and cover the circumferential surface and the distal end of the elongated probe.

12. The vaginal and clitoral probe of claim 1, wherein the at least one visual display element is on the elongated probe.

13. The vaginal and clitoral probe of claim 1, wherein the at least one visual display element is on the docking station.

* * * * *